US005619858A

United States Patent [19]

Gunderson et al.

[11] Patent Number: 5,619,858

[45] Date of Patent: Apr. 15, 1997

[54] ICE BUCKET DEPTH SENSOR

[75] Inventors: Richard L. Gunderson, Greenville; Timothy L. Varney, Belding; Curtis W. Sisson, Sheridan, all of Mich.

[73] Assignee: White Consolidated Industries, Inc., Cleveland, Ohio

[21] Appl. No.: 598,636

[22] Filed: Feb. 12, 1996

[51] Int. Cl.[6] ..... F25C 5/18

[52] U.S. Cl. ..... 62/137; 62/344

[58] Field of Search ..... 62/137, 344, 353

[56] References Cited

U.S. PATENT DOCUMENTS

| | | | |
|---|---|---|---|
| 2,799,144 | 7/1957 | Barton | 62/137 |
| 2,976,697 | 3/1961 | Dahl | 62/137 |
| 3,048,023 | 8/1962 | Taylor . | |
| 3,119,639 | 1/1964 | Adams . | |
| 3,290,892 | 12/1966 | Roedter . | |
| 3,331,215 | 7/1967 | Shaw . | |
| 3,360,951 | 1/1968 | Hoenisch . | |
| 3,397,715 | 8/1968 | Fathauer . | |
| 3,436,928 | 4/1969 | Swerbinsky . | |
| 3,474,637 | 10/1969 | Buchser . | |
| 3,545,217 | 12/1970 | Linstromberg . | |
| 3,885,400 | 5/1975 | Webb . | |
| 3,911,691 | 10/1975 | Kohl et al. . | |
| 4,566,286 | 1/1986 | Keller . | |
| 4,741,169 | 5/1988 | Linstromberg . | |
| 4,756,165 | 7/1988 | Chestnut et al. . | |
| 4,803,847 | 2/1989 | Koeneman et al. . | |
| 4,822,996 | 4/1989 | Lind . | |
| 4,872,318 | 10/1989 | Klemmensen . | |
| 4,947,652 | 8/1990 | Arcangeli | 62/137 |
| 5,119,639 | 6/1992 | Beiin et al. | 62/137 |

*Primary Examiner*—William E. Tapolcai
*Attorney, Agent, or Firm*—Pearne, Gordon, McCoy & Granger

[57] ABSTRACT

An ice maker is provided which ejects ice pieces into a storage receptacle disposed beneath the ice maker during an ice harvesting cycle. The ice maker includes a rotatable bail arm which initiates the ice harvesting cycle to supply the ice pieces to the receptacle and has a generally horizontal first portion which extends over the receptacle and a second portion which extends at an angle to the first portion. The ice maker also includes a molded plastic sensing element having a pair of spaced apart eyelets adapted to receive the first portion of said bail arm and pivotally support the sensing arm on the bail arm between a "high ice" position and a "low ice" position. The sensing element is pivoted between the "high ice" and "low ice" positions to adjust the level of the ice pieces which is maintained in the receptacle. The sensing element has integrally molded resilient snaps which are adapted to engage the second portion of the bail arm to removably secure the sensing element to the bail arm in either position. A first ice engaging surface is located on the sensing element at a first distance from the bail arm which engages at least one of the ice pieces in the receptacle to maintain the ice pieces at a predetermined high level in the receptacle when the sensing element is in the "high ice" position. A second ice engaging surface is located on the sensing element at a second distance from the bail arm which engages at least one of the ice pieces in the receptacle to maintain the ice pieces at a predetermined low level in the receptacle when the sensing element is in the "low ice" position.

15 Claims, 2 Drawing Sheets

Fig. 1
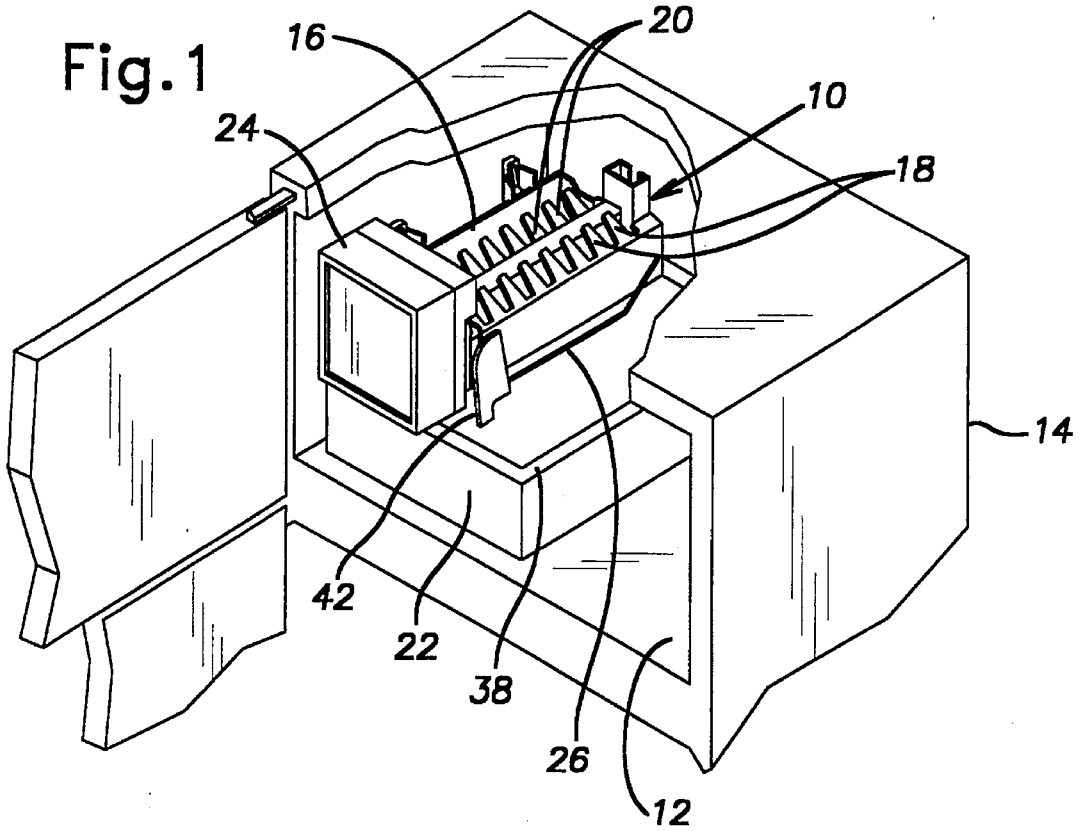
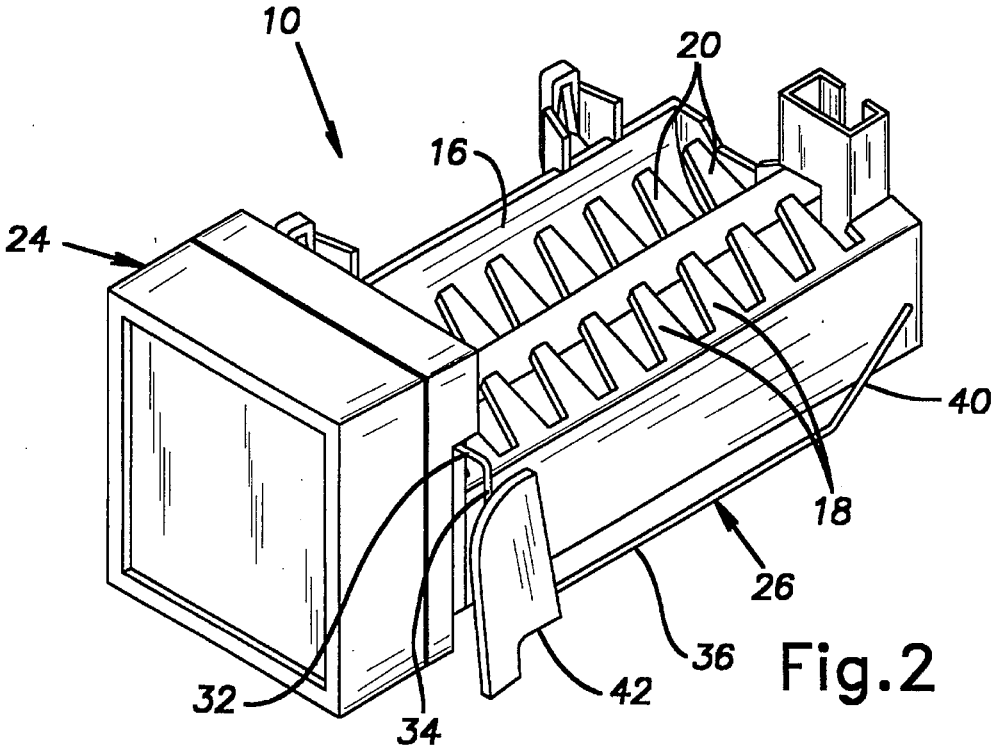
Fig. 2

ICE BUCKET DEPTH SENSOR

BACKGROUND OF THE INVENTION

1. Field of the Invention

The present invention relates in general to an automatic ice maker which supplies ice pieces to a storage receptacle during an ice harvesting cycle and, more specifically, to a depth sensor for the ice maker which is adjustable to inactivate the ice maker at more than one level of ice pieces in the receptacle.

2. Description of Related Art

Automatic ice makers typically have a feeler or bail arm for activating an ice level sensing switch whenever a storage bin or receptacle becomes full of ice pieces. The bail arm is raised after ice pieces have been ejected from the ice maker following each ice making cycle and lowered after the ice pieces have been received in the storage receptacle. When the ice pieces fill the storage receptacle to a predetermined level, the bail arm is prevented by the accumulated ice pieces from returning to its position in which the ice level sensing switch is closed to initiate another ice harvesting cycle. When enough of the ice pieces are removed so that the ice pieces no longer fill the storage receptacle to the predetermined level, the bail arm returns to its position where the ice level sensing switch initiates an ice harvesting cycle. In this manner, the ice pieces in the storage receptacle are maintained at the predetermined level.

Usage of ice pieces often varies from a high level during high consumption times to a low level at low consumption times. If the predetermined level of ice pieces in the storage receptacle is set to provide an adequate supply of ice pieces during high consumption times, only a top portion of the ice pieces in the receptacle is used during low consumption times. The lower portion of ice pieces may remain in the storage receptacle for an extended period of time and become stale. If the predetermined level of ice pieces in the storage receptacle is set to provide an adequate supply of ice pieces during low consumption times, there will not be an adequate supply of the ice pieces in the receptacle during high consumption times. Accordingly, there is a need in the art for an automatic ice maker which provides the ice pieces at different predetermined levels within the storage receptacle. Furthermore, there is a need for the ice maker to be easily adjustable between the levels and relatively inexpensive to produce.

SUMMARY OF THE INVENTION

The present invention provides an ice maker which ejects ice pieces into a storage receptacle during an ice harvesting cycle and overcomes at least some the above-described problems of the related art. The ice maker includes a rotatable bail arm which initiates the ice harvesting cycle to supply the ice pieces to the receptacle. The ice maker also includes a sensing element which is pivotally supported on the bail arm between a first position and a second position to adjust the maximum level of ice pieces in the receptacle. The sensing element has a body which forms an opening adapted to receive the bail arm. A first ice engaging surface is located on the sensing element at a first distance from the bail arm which engages at least one of the ice pieces in the receptacle to stop the supply of ice pieces at a first predetermined level in the receptacle when the sensing element is in the first position. A second ice engaging surface located on the sensing element at a second distance from the bail arm which engages at least one of the ice pieces in the receptacle to stop the supply of ice pieces at a second predetermined level in the receptacle when the sensing element is in the second position.

BRIEF DESCRIPTION OF THE DRAWINGS

These and further features of the present invention will be apparent with reference to the following description and drawings, wherein:

FIG. 1 is a fragmentary perspective view of an ice maker in accordance with the present invention, installed in a typical refrigerator having an upper freezer compartment;

FIG. 2 is an enlarged perspective view of the ice maker of FIG. 1;

DETAILED DESCRIPTION OF THE PREFERRED EMBODIMENT

Figure 3:
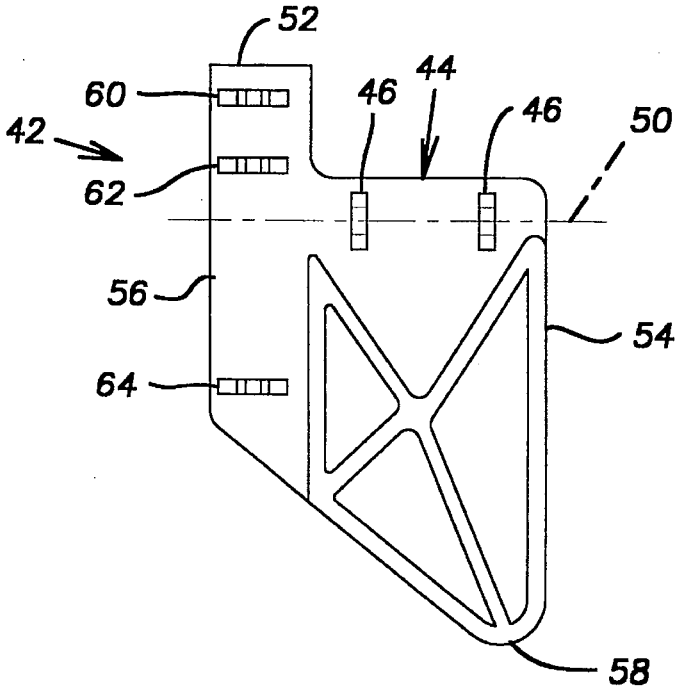
FIG. 3 is a front elevational view of a depth sensor according to the invention of the ice maker of FIG. 1.

FIG. 1 illustrates a typical installation of an automatic ice maker 10 incorporating the present invention in a freezer compartment 12 of a refrigerator 14. The ice maker 10 includes a mold 16 having a plurality of cavities in which water is held while it freezes to form ice-cubes or pieces. The water is typically supplied to the cavities from a normal household source. An array of stationary fingers 18 are provided along one side of the mold 16. An array of ejector fingers 20 are also provided within the mold 13 which interleave with the stationary fingers 18 and cooperate therewith to cause the ice pieces to be deposited in a storage bucket or receptacle 22 disposed below the ice maker 10. The ejector fingers 20 rotate or pivot about an a substantially horizontal and longitudinally extending axis to eject the ice pieces from the mold 16.

Naturally, the scope of the present invention is not limited to the specific mold and ejection configurations described herein. Rather, it is evident that any suitable type of mold and ejector arrangement may be employed to supply the ice pieces to the storage receptacle 22.

An automatic control system is provided to control the supply of ice pieces into the receptacle 22. The control system includes a motor (not shown) within a housing assembly 24 mounted at one end of the ice maker 10 and operably connected to the array of ejector fingers 20 to rotate the array of ejector fingers 20 to eject the ice pieces. The control system also includes a stop or bale arm 26 that automatically terminates operation of the ice maker 10 when a desired level of ice pieces is located within the receptacle 22 and initiates operation of the ice maker 10 when less than a desired level of ice pieces is located within the receptacle 22.

As best shown in FIG. 2, a first end of the bail arm 26 extends into the housing assembly 24 and is operably connected to the motor with a cam or lever assembly to rotate or pivot the bail arm 26. The bail arm 26 rotates about a substantially horizontal and longitudinally extending axis 28 (FIGS. 6 and 7) which is substantially parallel to the pivot axis of the array of ejector fingers 20. Rotation of the bail arm 26 opens an ice level sensing switch to prevent cycling of the ice maker 10 when the ice pieces within the receptacle 22 are at the desired level and closes the ice level sensing switch to initiate cycling of the ice maker 10 when the ice pieces within the receptacle 22 are below the desired level.

The bail arm 26 of the illustrated embodiment includes substantially horizontal and longitudinally extending first portion 30 (FIGS. 6 and 7) at the first end of the bail arm 26. A second portion 32 of the bail arm 26 extends generally perpendicularly from the first portion 30 and laterally outward from the ice maker 10. A third portion 34 extends generally perpendicularly from an outer end of the second portion 32 and downwardly toward the receptacle 22. A fourth portion 36 extends generally perpendicularly from a lower end of the third portion 34 and longitudinally adjacent a top 38 of the receptacle 22. The fourth portion 36 is substantially horizontal and generally parallel with the pivot axis 28 of the bail arm 26. Preferably, an upwardly angled fifth portion 40 extends from the fourth portion 36 at a second or outer end of the bail arm 26. It is noted that the bail arm 26 could alternatively have other shapes within the scope of the present invention such as, for example, the bail arm could be generally U-shaped.

Figure 4:
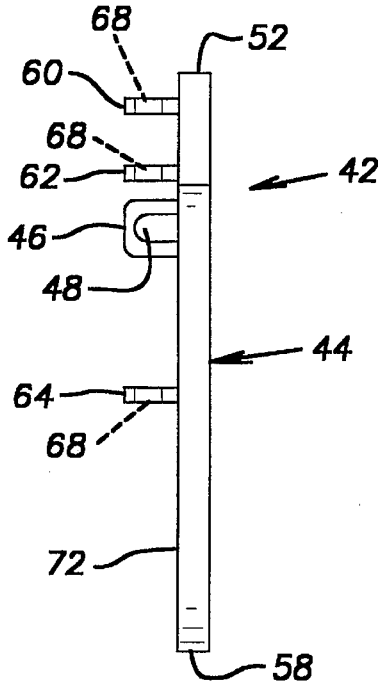
FIG. 4 is a bottom plan view of the depth sensor of FIG. 3.
Figure 5:
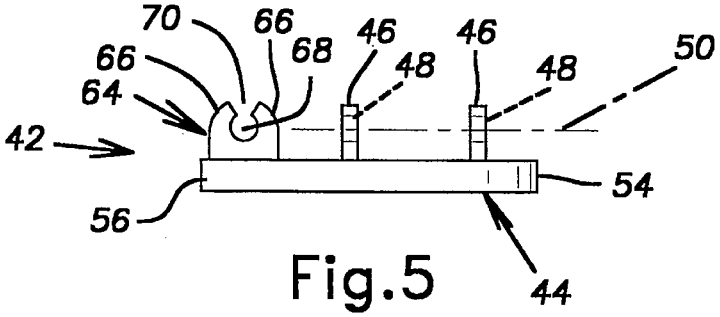
FIG. 5 is a side elevational view of the depth sensor of FIG. 3.

A depth sensing element 42 is pivotally supported on the fourth portion 36 of the bail arm 26. As best shown in FIGS. 3–5, the sensing element 42 includes a generally planar or plate-like body 44. The sensing element 42 also includes a pair of spaced apart eyelets 46 which each form an opening 48 for receiving the bail arm 26 therethrough. The openings 48 form a pivot axis 50 for the sensing element 42. The openings 48 are sized such that the sensing element 42 can pivot or rotate about the ball arm 26.

A first end of the body 42 forms a first ice engaging surface 52. The first ice engaging surface 52 is generally parallel with the pivot axis 50 of the sensing element 42. The first ice engaging surface 52 is preferably spaced a distance from the pivot axis 50 such that the first ice engaging surface 52 is located adjacent or near the top 38 of the receptacle 22 when the sensor element 42 is positioned on the bail arm 26 with the first end facing downward. Preferably, the first end of, the sensing element 42 is notched at a first side 54 of the body 44 such that only a portion of the first end forms the first ice engaging surface 52 adjacent a second side 56 of the body 44. It is noted that the eyelets 46 are located generally adjacent the first side 54 of the body 44.

A second end of the body 44, opposite the first end, forms a second ice engaging surface 58. The second ice engaging surface 58 is spaced a distance from the pivot axis 50 such that the second ice engaging surface 58 is positioned within the receptacle 22 when the sensor element 42 is positioned on the bail arm 26 with the second end facing downward. Therefore, the second ice engaging surface 58 is located a greater distance from the pivot axis 50 than the first ice engaging surface 52. Preferably, the second end of the sensing element 42 is angled such that only a portion of the second end forms the second ice engaging surface 58 adjacent the first side 54 of the body 44. The first and second ice engaging surfaces 52, 58, therefore, are located on opposite sides 54, 56 as well as opposite ends of the body 44. It is noted that the second end could alternatively have other shapes such as, for example, a curved or arcuate shape (as shown in FIGS. 1 and 2).

The sensing element 42 also includes connectors 60, 62, 64 which removably secure the sensing member 42 to the bail arm 42 with either the first or second end facing downward. Preferably, the sensing member 42 is molded in one piece from a suitable plastic material such as, for example, polypropylene. The connectors 60, 62, 64 of the preferred embodiment are integrally molded snaps. As best shown in FIG. 5, each snap-type connector or snap 60, 62, 64 includes a pair of fingers 66 which form an opening 68 sized to securely receive the bail arm 26. The opening 68 is sized such that the sensing element 42 is secured to the bail arm 26 to prevent rotation of the sensing element 42 about the bail arm 26. The fingers 66 form a mouth 70 to the opening 68 sized such that the fingers deflect resiliently outwardly when the bail arm 26 is snapped into or out of the opening 68 through the mouth 70. It is noted that other types of suitable connectors could alternatively be utilized to removably secure the sensing element 42 to the bail arm 26 such as, for example, clips, hooks, or latches.

The illustrated sensing element 42 includes three snaps 60, 62, 64, each located adjacent the second side 56 of the body 44. Two of the snaps 60, 62 are located adjacent the first end of the body 44 and one of the snaps 64 is located adjacent the second end of the body 44. The openings 68 of the snaps 60, 62, 64 are generally aligned and generally perpendicular to the openings 48 of the eyelets 46, that is, the central axis of the openings 68 of the snaps 60, 62, 64 is generally perpendicular to the pivot axis 50 of the sensing element 42. The snaps 60, 62, 64 are each spaced a distance from the pivot axis 50 of the sensing element 42 such that the snaps 60, 62, 64 can receive the third portion 34 of the bail arm 26 to prevent rotation of the sensing element 42 about the forth portion 36 of the bail arm 26 extending through the eyelets 46. It is noted that both the snaps 60, 62, 64 and the eyelets 46 are located on an inner side 72 of the sensing element 42 such that the sensing element 42 is located on an outer side of the bail arm 26 when the first end of the sensing element 42 is located downward (shown in FIGS. 1, 2, and 6).

Figure 6:
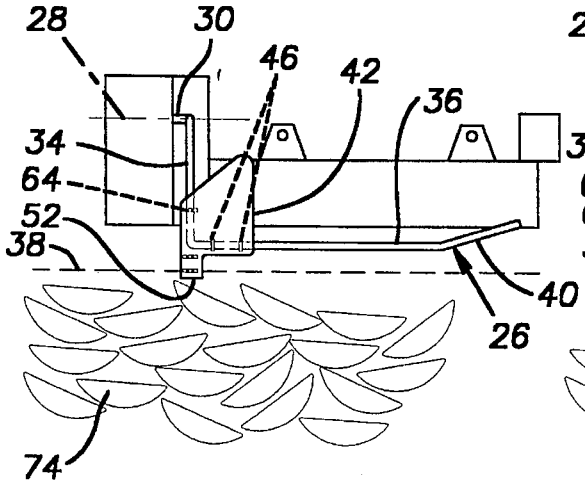
FIG. 6 is a front elevational view of the ice maker with the depth sensor at a high ice level position.

The sensing element 42 is installed by inserting the second end of the bail arm 26 through the openings 48 of the eyelets 46 and sliding the sensing element 42 along the bail arm 26 until the snaps 60, 62, 64 are in alignment with the third portion 34 of the bail arm 26. The sensing element 42 typically is secured to the bail arm 26 in a first or "high ice" position where the first end of the sensing element 42 faces downward as shown in FIGS. 1, 2, and 6. During an ice harvesting cycle the bail arm 26 is rotated about the pivot axis 28 from a low error first position where the first end of the sensing element 42 is slightly,within the receptacle 22 or near the top 38 of the receptacle 22 to an upper or second position where the first end of the sensing element 42 is raised above the top 38 of the receptacle 22. In the upper position the ice level sensing switch is opened. Ice pieces 74 are ejected from the mold 16 into the receptacle 22 and the bail arm 26 is returned to the lower position. When the ice pieces 74 reach a predetermined first or higher level, however, the first ice engaging surface 52 of the sensing element 42 engages the ice pieces 74 in the receptacle 22 and prevents rotation of the bail arm 26. As a result, the bail arm 26 cannot return to the lower position in which the ice level sensing switch is closed to permit initiation of another ice harvesting cycle. This stops further ice harvesting until some of the ice pieces 74 are removed from the receptacle 22 which permits the bail arm 26 to return to its lower position where the ice level sensing switch, is closed and another ice harvesting cycle is initiated.

Figure 7:
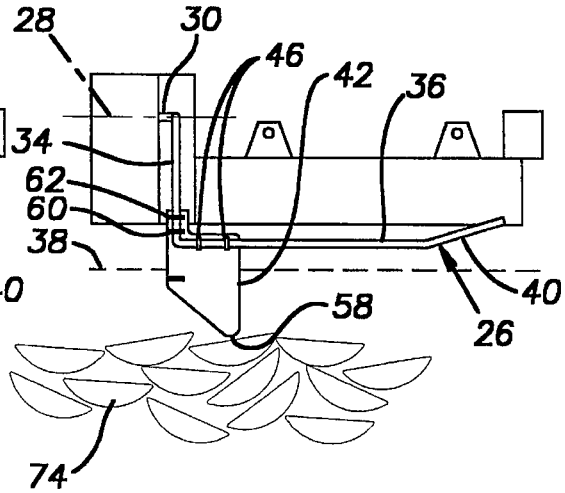
FIG. 7 is a front elevational view of the ice maker with the depth sensor at a low ice level position.

During low ice consumption times, the maximum level of ice pieces 74 within the receptacle 22 can be adjusted to a predetermined second or lower level which is lower than the first level. This lower level will keep the ice pieces 74 in the receptacle 22 fresher during low ice consumption times because the ice pieces 74 will remain in the receptacle 22 for a shorter period of time. The maximum level is adjusted to the lower level by pivoting the sensing element 42 to a second or "low ice" position where the second ice engaging surface faces 58 downward as shown in FIG. 7. The sensing element 42 is pivoted from the first position to the second position by outwardly pulling on the second end of the sensing element 42 until the third portion 34 of the bail arm 26 resiliently snaps out of the snap 64. The sensing element 42 is then downwardly rotated about the fourth portion 36 of the bail arm 26 until the first end of the sensing element 42 engages the inner side of the bail arm 26 and the third portion 34 of the bail arm 26 resiliently snaps into the snaps 60, 62. With the sensing element 42 secured in the second position, the second ice engaging surface 58 extends within the receptacle 22 a further distance than the first ice engaging surface 52 does in the first position so that the maximum level of ice pieces 74 in the receptacle 22 is reduced to a lower level.

In preparation for a high ice consumption time when the higher level of ice pieces 74 in the receptacle 22 is desired, the sensing element 42 is easily unsnapped from the second position, pivoted upward, and re-snapped in the first position. The ice maker 10 will then supply ice pieces 74 to the receptacle 22 until the higher level is reached within the receptacle 22. From the above-description, it can be seen that the sensing element 42 maintains the ice pieces 74 at more than one predetermined level within the receptacle 22, is easily adjusted, and is relatively inexpensive to produce.

Although particular embodiments of the invention have been described in detail, it will be understood that the invention is not limited correspondingly in scope, but includes all chances and modifications coming within the spirit and terms of the claims appended hereto.

What is claimed is:

1. An ice maker which ejects ice pieces into a storage receptacle during an ice harvesting cycle, said ice maker comprising:

a rotatable bail arm which initiates the ice, harvesting cycle to supply the ice pieces to the receptacle; and a sensing element pivotally supported on said bail arm between a first position and a second position and having a body forming an opening adapted to receive said bail arm, a first ice engaging surface located a first distance from said bail arm effective for engaging at least one of the ice pieces in the receptacle to stop the supply of ice pieces at a first predetermined level in the receptacle when said sensing element is in said first position, and a second ice engaging surface located a second distance from said bail arm effective for engaging at least one of the ice pieces in the receptacle to stop the supply of ice pieces at a second predetermined level in the receptacle when said sensing element is in said second position.

2. The ice maker according to claim 1, wherein said body is generally plate-shaped and said first engaging surface and said second engaging surface are formed at opposite ends of said body.

3. The ice maker according to claim 1, wherein said sensing element is molded of plastic.

4. The ice maker according to claim 3, wherein said sensing element includes resilient snaps adapted to removably secure said sensing element to said bail arm in said first and second positions.

5. The ice maker according to claim 1, wherein said opening is formed by a pair of spaced apart eyelets adapted to receive said bail arm and pivotally support said sensing arm on said bail arm.

6. The ice maker according to claim 1, wherein said sensing element includes connectors adapted to removably secure said sensing element to said bail arm in said first and second positions.

7. The ice maker according to claim 6, wherein said bail arm has a generally horizontal first portion which extends over the receptacle and a second portion which extends at an angle to said first portion, and said sensing element is pivotally supported by said first portion of said bail arm.

8. The ice maker according to claim 1, wherein said connectors of said sensing element engage said second portion of said bail arm.

9. An ice maker which ejects ice pieces into a storage receptacle during an ice harvesting cycle, said ice maker comprising:

a rotatable bail arm which initiates the ice harvesting cycle to supply the ice pieces to the receptacle and has a generally horizontal first portion which extends over the receptacle to control the supply of ice pieces to the receptacle and a second portion which extends at an angle to said first portion; and a molded plastic sensing element having a pair of spaced apart eyelets adapted to receive said first portion of said bail arm and pivotally support said sensing arm on said bail arm between a first position and a second position, resilient snaps adapted to engage said second portion of said bail arm to removably secure said sensing element to said bail arm in said first and second positions, a first ice engaging surface located a first distance from said bail arm effective for engaging at least one of the ice pieces in the receptacle to stop the supply of ice pieces at a first predetermined level in the receptacle when said sensing element is in said first position, and a second ice engaging surface located a second distance from said bail arm effective for engaging at least one of the ice pieces in the receptacle to stop the supply of ice pieces at a second predetermined level in the receptacle when said sensing element is in said second position.

10. A sensing element for an ice maker which ejects ice pieces into a storage receptacle during an ice harvesting cycle and has a rotatable bail arm which initiates the ice harvesting cycle to supply the ice pieces to the receptacle, said sensing element comprising:

a body forming an opening adapted to receive said bail arm and pivotally support said sensing element on said bail arm between a first position and a second position;

a first ice engaging surface formed by said body and located a first distance from said bail arm effective for engaging at least one of the ice pieces in the receptacle to stop the supply of ice pieces at a first predetermined level in the receptacle when said sensing element is in said first position; and a second ice engaging surface formed by said body and located a second distance from said bail arm effective for engaging at least one of the ice pieces in the receptacle to stop the supply of ice pieces at a second predetermined level in the receptacle when said sensing element is in said second position.

11. The sensing element according to claim 10, wherein said body is generally plate-shaped and said first engaging surface and said second engaging surface are formed at opposite ends of said body.

12. The sensing element according to claim 10, wherein said sensing element is molded of plastic.

13. The sensing element according to claim 12, wherein said sensing element includes resilient snaps adapted to removably secure said sensing element to said bail arm in said first and second positions.

14. The sensing element according to claim 10, wherein said opening is formed by a pair of spaced apart eyelets adapted to receive said bail arm and pivotally support said sensing arm on said bail arm.

15. The sensing element according to claim 10, further comprising connectors adapted to removably secure said sensing element to said bail arm in said first and second positions.

* * * * *